US006286560B1

(12) United States Patent
Schwemmlein et al.

(10) Patent No.: US 6,286,560 B1
(45) Date of Patent: Sep. 11, 2001

(54) DEVICE FOR PRODUCING A LENO SELVEDGE FOR A LOOM WITH HEALD FRAMES

(75) Inventors: Christoph Schwemmlein; Kurt Hockemeyer, both of Borken-Weseke (DE)

(73) Assignee: Klocker-Entwicklungs-GmbH, Borken-Weseke (DE)

( * ) Notice: Subject to any disclaimer, the term of this patent is extended or adjusted under 35 U.S.C. 154(b) by 0 days.

(21) Appl. No.: 09/518,984

(22) Filed: Mar. 3, 2000

Related U.S. Application Data

(63) Continuation of application No. PCT/DE98/02844, filed on Sep. 24, 1998.

(30) Foreign Application Priority Data

Oct. 4, 1997 (DE) ..... 197 43 872

(51) Int. Cl.[7] ..... D03C 7/00; D03D 51/02
(52) U.S. Cl. ..... 139/54
(58) Field of Search ..... 139/54

(56) References Cited

U.S. PATENT DOCUMENTS 5,524,678 6/1996 Haeussler et al. .
5,996,646 * 12/1999 Hockemeyer et al. ..... 139/54
5,998,228 * 12/1999 Krumm ..... 139/54
6,006,793 * 12/1999 Krumm et al. ..... 139/54

FOREIGN PATENT DOCUMENTS 44 05 776 8/1995 (DE) .
63-145446 6/1988 (JP) .
0369627 3/1991 (JP) .
WO 94/29502 12/1994 (WO) .
WO 96/38608 12/1996 (WO) .
WO 97/24479 7/1997 (WO) .

* cited by examiner

*Primary Examiner*—Andy Falik
(74) *Attorney, Agent, or Firm*—Thomas R. Vigil

(57) ABSTRACT

A device for producing a leno selvedge for a loom receives a weft thread and comprises: heald frames which form a shed. The device comprises an electric motor with a rotor having two guide elements for doup ends, and a control system. The electric motor is driven by the control system. In one embodiment, the control system of the electric motor is given a pilot pulse generated from the opening or closing of the shed at the very moment when the loom is starting to open or to close the shed. In another embodiment, the control system of the electric motor is given a pilot pulse, generated by the insertion of or completion of the insertion of, the weft thread, at the very moment when the insertion of the weft thread is starting or when the weft insertion has been accomplished.

2 Claims, 2 Drawing Sheets

DEVICE FOR PRODUCING A LENO SELVEDGE FOR A LOOM WITH HEALD FRAMES

CROSS-REFERENCE TO RELATED APPLICATIONS

This application is a continuation of PCT-Application No. PCT/DE 98/02844 filed Sep. 24, 1998 and claims priority from German Patent Application No. 197 43 872.5, filed Oct. 4, 1997.

BACKGROUND OF THE INVENTION

1. Field of the invention

The present invention relates to a device for producing a leno selvedge for a loom with heald frames according to the preamble of claims 1 and 2.

2. Description of the prior art.

JP-369 627 discloses a planet rotator for producing a leno selvedge. This is a device in which the planet wheels carry the bobbins, which means that the bobbins are also rotating. The device works in such a manner so that the planet wheels are guided according to the angle of rotation of the heald frames. That means that such a planet rotator for producing a leno selvedge executes a continuous motion of rotation corresponding to the motion of the angle of rotation of the heald frames, that is that a mating angle of rotation of the heald frames is associated to each angle of rotation of the planet rotator.

Indeed, such a planet rotator is working irrespective of the drive of the heald frames, which makes it possible to have the planet rotator leading or lagging behind the heald frames with regard to the angle of rotation.

A device for producing a leno selvedge is known for example out of DE 44 05 776 C 1. There, an electrically driven motor operator is provided, which actuates a doup disc, whereby the doup disc constitutes the rotor of the electrically driven motor operator. The doup disc itself has at least two guide elements for the doup ends, whereby the leno selvedge is formed by turning the doup ends around the weft thread.

The WO 97/24479 discloses a device for producing a leno selvedge, whereby the rotor of an electric motor is provided with arms for guiding the doup ends. Here too, the leno selvedge is produced by wounding the doup ends guided by the arms around the weft thread.

These two well-known devices have in common that, to produce the leno selvedge, an electric motor is provided that at any time synchronizes with the motion of the heald frames. However, this electric motor can also be actuated so that it is dephased relative to the motion of the heald frames, in order for example to allow an early tying of the weft thread. But actually, an orientation of the motion of the electric motor's rotor always occurs relative to the motion of the frame. This clearly shows that, in order to execute this described synchronization of the leno selvedge device with the motion of the heald frames, data continuously have to be transmitted, in particular from the drive shaft of the loom to the leno selvedge device, so that the synchronization of the electric motor of the leno selvedge device with the loom, that is with the motion of the heald frames, can be achieved. In this respect it has also been foreseen that the electric motor is coupled to the actuation of the loom via a so-called electric shaft. This does not mean that, in the known device, the control of the leno selvedge device is depending on the heald frame; on the contrary, the control and, accordingly, the motion of rotation of the electric motor's rotor of the leno selvedge device does not depend on the heald frame, since no direct mechanical coupling is provided between the heald frames and the leno selvedge device. Still, as already explained, the leno selvedge device is coupled with the loom in as much as the motion of the leno selvedge device, that is of the electric motor's rotor, is synchronized with the motion of the drive shaft of the loom, or according to the motion of the heald frames.

It however proved to come to the same whether, for producing a leno selvedge, the rotor of the electric motor of the leno selvedge device is or not exactly and at any time synchronized with the motion of the loom—that is of the drive shaft or the heald frames of the loom respectively. The only essential point is rather that, when the leno selvedge device is starting the weft insertion, the two doup ends are also in the open position of the shed and that, once the weft insertion has been accomplished, the doup ends are going into their closed position of the shed. That means that the essential point is exclusively that the respective final position, i.e. "open shed" or "closed shed" is reached by the leno selvedge device at the latest when the heald frames are occupying an appropriate position. The consequence thereof is that a synchronization at all time of the motion of the electric motor's rotor with the motion of the heald frames is not at all necessary.

SUMMARY OF THE INVENTION

The object of the present invention is therefore to provide a device of the type mentioned above, by means of which the electric motor of a device for producing a leno selvedge may be driven in such a manner so that the tying is done without depending on the motion of the heald frames, but still within the period of time between the open position of the shed and the closed position of the shed of the frames.

According to a first variant, the solution of this object is that the control system of the electric motor is given a pilot pulse at the very moment when the loom is starting to open or to close the shed. Another variant for solving this problem is to engineer the control system of the electric motor in such a manner so that it is depending on the weft insertion. In this respect and according to the second variant, it has been foreseen that the control system of the electric motor is given a pilot pulse at the very moment when the insertion of the weft thread is starting, or when the weft insertion has been accomplished. In both cases however, the rotational speed of the electric motor's rotor used to open and close the shed has necessarily to be higher than the speed with which the heald frames open and close the shed. The advantage of this control system is that it is much simpler in its structure and thus less costly since only a few parameters, actually exactly two parameters are required in order to control the device for producing a leno selvedge. In this respect, this leno selvedge device also works with far less trouble than a device with the control system of the art.

In the following, the invention is explained in more detail with the help of the drawing.

DESCRIPTION OF THE PREFERRED EMBODIMENT(S)

For a better understanding of the device, the way of operation of the leno selvedge device will be explained once more; in this respect, reference is made also to the disclosure according to WO 97/24479.

Figure 1:
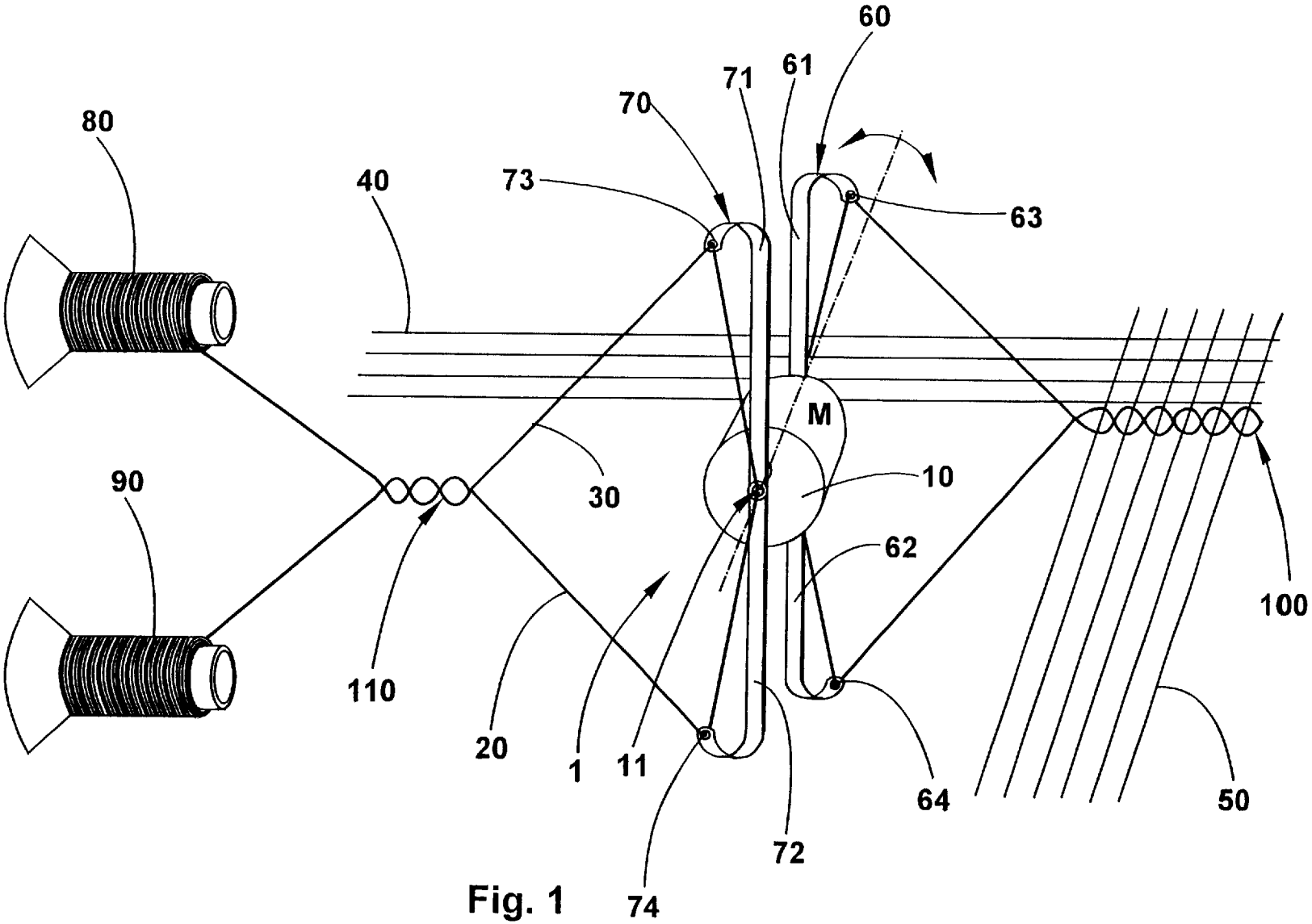
FIG. 1 shows a diagrammatic view of the device according to the invention with respect to its position relative to the fabric, whereby the frames and the reed have been omitted for the sake of clarity.

In the device 1 illustrated in FIG. 1, an electric motor referred to as a whole with numeral 10 is provided, which has a centrical bore 11 for guiding the doup ends 20, 30. In the embodiment shown, which has the rotational axis running across the warp threads 40, that is essentially parallel to the weft threads 50, two pairs of arms 60, 70 are provided. It is however also possible to have the device working with only one pair of arms 60 that is accommodated on the side of the fabric on the rotor of the electric motor. These pairs of arms are designed like propeller blades and are accommodated on the rotor. Each pair of arms 60, 70 consists of two arms 61, 62 or 71, 72 respectively designed like propeller blades. The two pairs of arms 60, 70 are running parallel and are fastened on either front side of the rotor of the electric motor 10, as may be seen clearly in FIG. 1. At their ends, the arms 61, 62 and 71, 72 respectively are bent to form a hook and, are provided, in the area of the hook-shaped curve, with the eyes 73, 74 and 63, 64 respectively. These eyes serve for fitting the doup ends 20, 30 through, which have been unreeled from the bobbins of yarn 80, 90. When the pairs of arms 60, 70 are rotating, and here the pair of arms 60 in particular, the full leno selvedge 100 is being shaped on the fabric. In the area in which the doup ends 20, 30 are supplied from the bobbins, a twisting of the threads that is undone again by reversing the rotational direction of the rotor after a determined number of revolutions in one direction also occurs (at 110). That means that the rotor of the electric motor runs forward and backward. An untwisting of the leno selvedge 100 is avoided here by having the weft threads 50 inserted between the doup ends.

Figure 2:
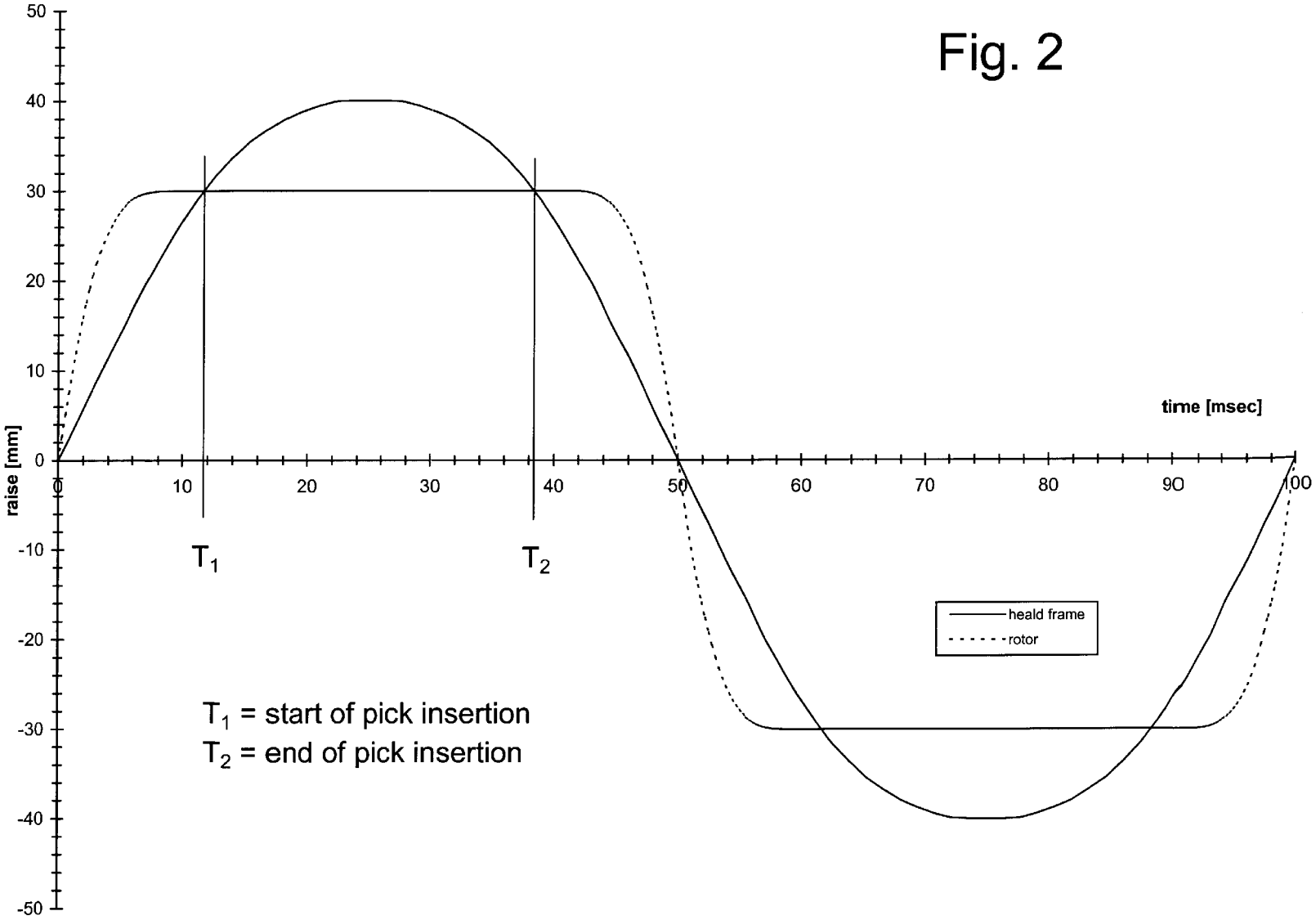
FIG. 2 shows a diagrammatic view of the course of the heald frames' path resp. the rotation of the rotor of the electric motor of the leno selvedge device over a period of time.

FIG. 2 shows the course of the motion of the heald frames on one hand and of the rotor of the electric motor of the leno selvedge device on the other over a period of time. It may be seen here that at the very moment, when the heald frames are finally open, the rotor already keeps the doup ends in the open position of the shed. The course of the curve also shows that the rotor of the electric motor is able to keep the shed open for a much longer period of time than the heald frames are. Thus, the device according to the invention can be operated with a smaller shed and can, which is also essential, be mounted far at the front, namely between the sheds directly on the reed. The fact that the shed is kept open for such a long period of time allows for the special requirements of rapier looms in as much as the rapier has more time to stay in the shed.

The advantage of such a control system is that it is much easier to accomplish since considerably less control signals have to be processed due to the fact that no electric shaft or electric cam has to be copied by means of considerable expenditure in control technique. That means that such a control system is also considerably less expensive to manufacture. Such a control system also proved to be less prone to failure. Moreover, this type of drive encourages the use of simple and thus reasonably priced step motors.

We claim:

1. Device for producing a leno selvedge for a loom comprising:

heald frames which form a shed, said device comprising an electric motor with a rotor which has two guide elements for doup ends, and a control system, said electric motor being driven by said control system at a rotational velocity for opening and closing the shed which is higher than the speed of the heald frames for opening and closing the shed, and said control system of electric motor being given a pilot pulse generated from the opening or closing of the shed at the very moment when the loom is starting to open the shed or to close the shed.

2. Device for producing a leno selvedge for a loom which receives a weft thread, comprising:

heald frames, said device comprising an electric motor with a rotor which has two guide elements for doup ends, and a control system said electric motor being driven by said control system at a rotational velocity for opening and closing the shed which is higher than the speed of the heald frames for opening and closing the shed, and said control system of the electric motor being given a pilot pulse, generated by the insertion of, or completion of the insertion of, the weft thread, at the very moment when the insertion of the weft thread is starting or when the weft insertion has been accomplished.

* * * * *